US007801279B2

(12) United States Patent
Jans et al.

(10) Patent No.: US 7,801,279 B2
(45) Date of Patent: Sep. 21, 2010

(54) ANTI-SCATTER DEVICE, METHOD AND SYSTEM

(75) Inventors: Jan Jans, Maasbracht (NL); Jaap Mulder, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 20 days.

(21) Appl. No.: 12/162,673

(22) PCT Filed: Jan. 23, 2007

(86) PCT No.: PCT/IB2007/050230

§ 371 (c)(1),
(2), (4) Date: Jul. 30, 2008

(87) PCT Pub. No.: WO2007/088498

PCT Pub. Date: Aug. 9, 2007

(65) Prior Publication Data

US 2009/0016494 A1 Jan. 15, 2009

(30) Foreign Application Priority Data

Feb. 2, 2006 (EP) ..... 06101179

(51) Int. Cl.
*G21K 1/00* (2006.01)

(52) U.S. Cl. ..... 378/154

(58) Field of Classification Search ..... 378/154, 378/147, 149; 250/505.1
See application file for complete search history.

(56) References Cited

U.S. PATENT DOCUMENTS

| | | | |
|---|---|---|---|
| 4,288,697 | A | 9/1981 | Albert |
| 4,951,305 | A | 8/1990 | Moore et al. |
| 5,606,589 | A | 2/1997 | Pellegrino et al. |
| 5,689,118 | A | 11/1997 | Van Beek |
| 6,594,342 | B2 | 7/2003 | Castleberry |
| 2003/0123615 | A1 | 7/2003 | Klausz |

FOREIGN PATENT DOCUMENTS

| | | | |
|---|---|---|---|
| DE | 4033896 | A1 | 4/1992 |
| EP | 1280165 | A2 | 1/2003 |
| JP | 58021582 | A | 2/1983 |
| JP | 03226699 | A | 10/1991 |
| WO | WO0173794 | A1 | 10/2001 |

*Primary Examiner*—Jurie Yun

(57) ABSTRACT

An anti-scatter device for suppressing scattered radiation includes a plurality of x-ray absorbing layers. The anti-scatter device further includes a plurality of spacer layers, such that each spacer layer is arranged between any two of the plurality of x-ray absorbing layers in order to hold each of the x-ray absorbing layers in a pre-defined orientation. Furthermore, each of the spacer layers includes a plurality of unsealed voids to reduce the absorption of x-rays incident on at least a portion of each of the spacer layers.

18 Claims, 7 Drawing Sheets

ANTI-SCATTER DEVICE, METHOD AND SYSTEM

The invention relates to the field of radiography. More particularly, the invention relates to an anti-scatter device.

The invention further relates to a method of manufacturing the anti-scatter device.

The invention further relates to a use of the anti-scatter device.

Anti-scatter devices are typically removable devices that are attached onto a detecting end of an x-ray imaging device. The anti-scatter device, typically situated between the object and the x-ray detection device, is advantageously used in the removal of background haze or loss of contrast in the generated x-ray image that are caused by scattered radiation. These anti-scatter devices are designed to selectively permit the passage of primary and attenuated x-rays passing through an object during an imaging procedure and absorbs or prevents the passage of scattered radiation. A typical anti-scatter device comprises an array of x-ray absorbing material, each separated by a spacer material. The array of x-ray absorbing material, which is typically made of lead, is oriented at specific angles that are specific to a particular x-ray imaging system. The spacer material is arranged to provide mechanical stability to the anti-scatter grid as well as to prevent changes in the orientation of the x-ray absorbing material. However, with the use of anti-scatter devices, the average power levels of the x-rays have to be increased. This is because of the increased absorption of x-rays by the x-ray absorbing material. Subsequently, the dosage of x-rays that a patient receives during an imaging procedure is increased with the use of the anti-scatter grid.

An embodiment of an anti-scatter device for radiography is disclosed in U.S. Pat. No. 6,594,342 B2. The anti-scatter device disclosed includes a plurality of generally radiation absorbing elements and a plurality of generally non-radiation absorbing elements. The plurality of generally non-radiation absorbing elements includes a plurality of voids and desirably that the non-radiation absorbing elements include an epoxy or a polymeric material and a plurality of hollow microspheres. The document further discloses an apparatus for forming the anti-scatter device in which the apparatus includes a pivoting arm and a surface for use in aligning a plurality of spaced-apart and generally radiation absorbing elements relative to a radiation source.

Using the technique as disclosed, it becomes difficult and expensive to manufacture the anti-scatter device. This is because of special requirements of including a plurality of microspheres in the generally non-radiation absorbing material. Furthermore, it is possible that some or all of these microspheres will degrade with time and cause varied absorption and non-absorption of scattered radiation in the anti-scatter device. This results in reduction in the resolution of the image generated.

It is, therefore, an object of the invention to provide an anti-scatter device that provides improved resolution of an image.

A first aspect of the invention provides an exemplary anti-scatter device for suppressing scattered radiation is disclosed. As explained hereinabove, the use of the term radiation in the present context should be construed as being x-rays. The anti-scatter device comprises a plurality of x-ray absorbing layers. The anti-scatter device further comprises a plurality of spacer layers, such that each spacer layer is arranged between any two of the plurality of x-ray absorbing layers in order to hold each of the plurality of x-ray absorbing layers in a pre-defined orientation. Furthermore, each of the plurality of spacer layers comprises a plurality of unsealed voids to reduce the absorption of x-rays incident on at least a portion on each of the spacer layers. Detailed information on the predefined orientation of the spacer layers with respect to the x-ray absorbing layers can be found in prior art document, U.S. Pat. No. 6,594,342 B2, which is herein incorporated by reference.

The plurality of unsealed voids on each of plurality of spacer layers may advantageously be used to further reduce the absorption of x-rays that are incident on each of the spacer layers, thereby facilitating proper detection of x-rays. A further advantage of having the plurality of unsealed voids on the spacer layers is that the dosage of x-rays that an object, for example a patient undergoing an imaging procedure is reduced. In other words, for a given dosage of x-rays that an object receives, using such a device as embodied herein facilitates the generation of an image with improved resolution. Furthermore, the device also facilitates a reduction in the amount of x-ray dosage received by the patient. This is because in an imaging apparatus using an anti-scatter device, the average x-ray power levels are higher than in a procedure where the anti-scatter device is not used. However, as will be appreciated by a person skilled in the art, anti-scatter devices are necessary to reduce the effects of scattered radiation that tend to reduce the resolution of the generated image.

In a further embodiment of the invention, the spacer layer in the anti-scatter device comprises a fiber material. Fiber material may advantageously be used due to ease of forming the plurality of voids, particularly when mechanical and/or optical means are used to form the plurality of voids and also because of ease with which the composite strips may be formed. For example, in one implementation, the fiber material could be a plant fiber material such as cotton paper.

In accordance with a further aspect of the invention, a method of manufacturing an anti-scatter device for suppressing scattered radiation is disclosed. The method comprises applying a first bonding material on a first surface of a spacer material. The method also comprises attaching at least a layer of x-ray absorbing material onto a second surface of the spacer material via a second bonding material to form a composite foil. The method also comprises forming a plurality of unsealed voids on at least a portion on each of the spacer material. The method further comprises forming a plurality of composite strips from the composite foil and stacking each composite strip over another of the composite strip from the plurality of composite strips. The method further comprises applying heat on the stacked composite strips to activate the first bonding material to bond the plurality of composite strips in a pre-defined orientation. One advantage of the anti-scatter device is that it is inexpensive to manufacture because it involves very little modification to existing processes of manufacturing anti-scatter grids that are currently being made while providing for improved resolution of the generated image when used in conjunction with a radiographic imaging apparatus.

The spacer material is typically less absorbent to x-rays than the x-ray absorbent material. As described previously, the spacer material is used in between each of the plurality of x-ray absorbent material to hold the x-ray absorbent material in a desired orientation. The spacer material is typically a fiber material. For example, in certain implementations, the spacer material may, for example, be a type of paper or paper-like material. However, appropriate material such as plastic or any other material that is generally non-absorbent to x-rays, may be substituted and should be considered to be within the scope of the invention. Other desired properties of the spacer material, apart from the ability to absorb as little x-rays as possible is to be able to provide mechanical stability to the device, and to be non-degradable over time.

The first bonding material is applied to the first surface of the spacer material. For example, shellac glue may be used as the first bonding material. The first bonding material is chosen such that it can be thermally activated at any desired point in time.

The x-ray absorbing material is attached to the second surface of the spacer material using the second bonding material. The x-ray absorbing material is arranged to absorb any scattered radiation i.e., any attenuated x-rays that does not contribute to generation of a proper image. It must be noted that when x-rays pass through an object, most of the x-rays get attenuated and pass through the object along the same direction of incidence. However, some of the x-rays, during passage through the object, are subjected to a change in direction due to scattering. In certain instances, the energy of the x-rays may be decreased in energy. These are termed as scattered radiation, which is a form of secondary radiation.

The arrangement of the spacer layer having the first bonding material and the second bonding material on either sides and the x-ray absorbing layer affixed to the spacer layer via the second bonding material is called the composite foil. Before the composite foil is formed, a plurality of unsealed voids is formed on the spacer layer. It must be noted that the plurality of unsealed voids may be formed on the spacer layer at any point in time prior to the formation of the composite foil. While the layer of spacer material generally is non-absorbent to radiation, there will be some amount of x-ray absorption by the spacer material. The formation of the unsealed voids on each layer of the spacer material further reduces the absorption of x-rays by the spacer material.

The composite foil is then cut into a plurality of composite strips. Once the composite strips are formed, they are stacked one on top of the other. It should be noted that, once the stacking is done, the x-ray absorbing layer of each of the composite strip would be in contact with the first bonding material of an adjacent composite strip. Furthermore, it should be evident that, notwithstanding the first and the second bonding material, each layer of x-ray absorbing material is essentially sandwiched between two layers of the spacer material and vice versa. As described hereinabove, the function of each layer of the spacer material includes allowing the passage of primary and attenuated x-rays, providing mechanical stability to the device as well as holding each of the layers of x-ray absorbing materials in a specified orientation.

Once the stack is formed, heat is applied on the stack to activate the first bonding material due to which, each of the composite strips in the stack bonds with its adjacent composite strip, thereby forming the device.

In a further embodiment of the invention, the method comprises forming the plurality of the unsealed voids on the spacer material prior to applying the first bonding material. An advantage of forming the plurality of voids on the spacer material in this manner is that easy handling of the spacer material is facilitated.

In a further embodiment of the invention, the method comprises forming the plurality of voids on the spacer material prior to forming the composite foil, but after the application of the first bonding material. An advantage of forming the plurality of voids on the spacer layer after application of the first bonding material but before the formation of the composite foil is that it eliminates protrusions of the first bonding material in the spacer material at an interface with the x-ray absorbing material.

In a further embodiment of the invention, the method comprises forming the plurality of the unsealed voids via at least one of a mechanical means, a chemical means or an optical means.

In a certain implementation, the mechanical means may comprise a device arranged to punch holes in the spacer material. In other implementations, the mechanical means may comprise a drilling device or a sawing device. In a certain other implementation, chemical means may be employed to form the plurality of voids on the spacer material using etching techniques commonly known in the art. In a certain other implementation, the plurality of voids may also be formed on the spacer material using optical means such as by the use of high intensity lasers. It should be noted that the choice of mechanical, chemical or optical means to form the plurality of holes depends on the size, shape of the unsealed voids that are required to be formed, as well as on the spacer material. An advantage of forming the unsealed voids on the spacer material is that it allows for better control during the formation of the voids. Also, in certain implementations, the unsealed voids may be formed in a manner that allows for different sized voids to be present at different spots along the spacer material depending on requirements.

In accordance with a further aspect of the present invention, an exemplary method of use of an anti-scatter device for suppressing scattered radiation in a data acquisition device is disclosed. The method involves providing the anti-scatter device for attachment on a detecting surface of the data acquisition apparatus such that the detecting surface is arranged to receive via the device at least a portion of x-rays emitted. The anti-scatter device comprises a plurality of x-ray absorbing layers arranged in a pre-defined orientation and a plurality of spacer layers such that each spacer layer is arranged between any two of the plurality of x-ray absorbing layers in order to hold the plurality of x-ray absorbing layer in the pre-defined orientation. Furthermore, each spacer layer comprises a plurality of voids arranged to reduce absorption of x-rays incident on at least a portion on each of the plurality of spacer layers.

These and other aspects of the invention will be apparent from and elucidated with reference to the embodiments described hereinafter as illustrated by the following Figures FIG. 1 is a diagrammatical representation in three-dimension of an exemplary arrangement of different layers to form a composite foil;

Figure 1:
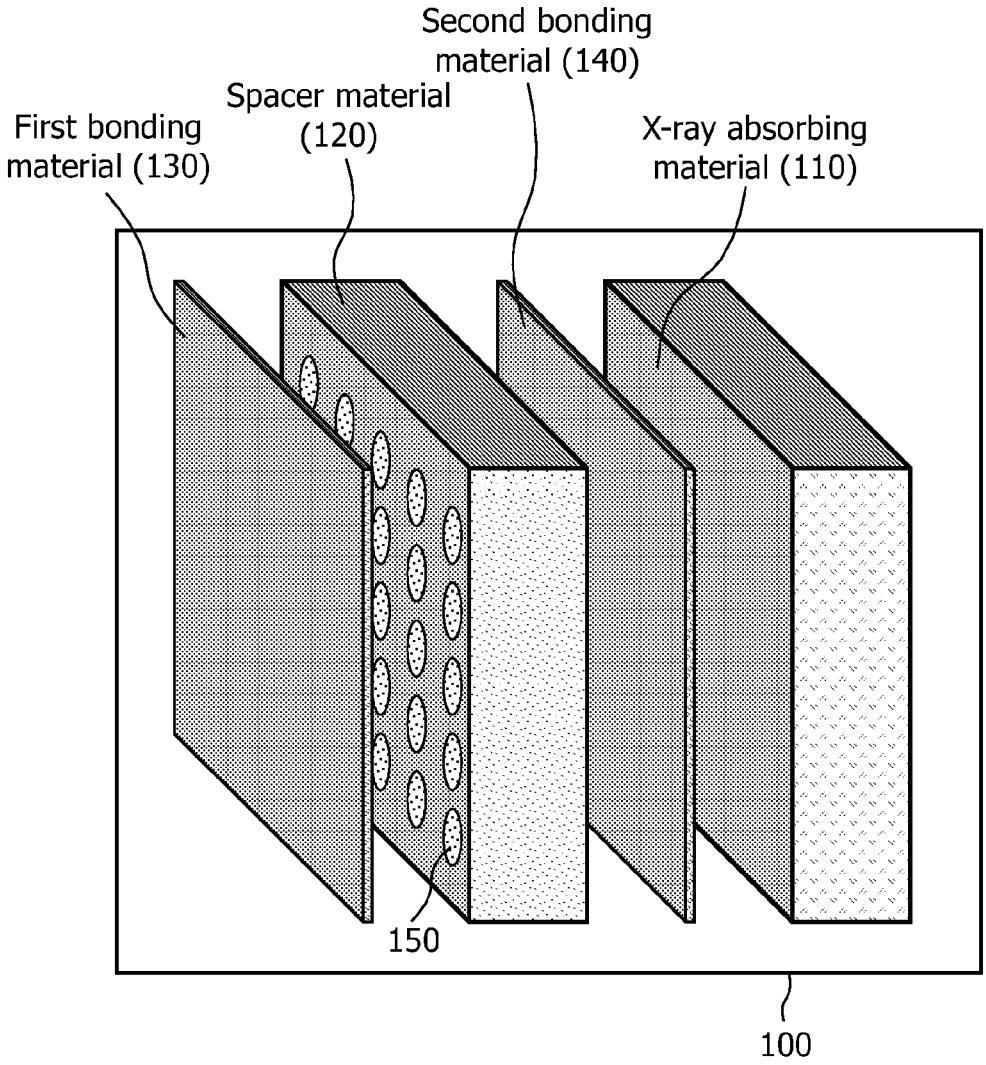

Turning now to the drawings and referring first to FIG. 1, an exemplary arrangement of a composite foil 100 that constitute and form an anti-scatter device for selectively passing x-rays is illustrated. The composite foil 100 comprises a layer of x-ray absorbing material 110, a layer of spacer material 120, a layer of a first bonding material 130 and a layer of a second bonding material 140. Furthermore, as stated previously, the layer of spacer material 120 comprises a plurality of voids, generally represented by reference numeral 150.

The layer of x-ray absorbing material 110 may typically constitute lead. However, with advancements in technology, any suitable x-ray absorbing material may be substituted in lieu of lead to achieve a similar functionality and that such substitution should be construed as being within the scope of the invention as described herein. In certain other implementations, the layer of x-ray absorbing material 110 may be constituted from a combination of two or more x-ray absorbing materials as well.

While in the presently illustrated figure, the plurality of voids 150 are shown as being oriented along a specific axis of the layer of spacer material 120, i.e., along the wider surface of the layer of the spacer material 120, it should be noted that in certain other implementations of the invention, the plurality of voids 150 may be situated along the any other planar orientation of the layer of spacer material 120. In other words, the plurality of voids 150 may be formed along a width of the layer of spacer material 120. However, for all discussions herein below, the former arrangement of the plurality of voids 150 shall be considered. Detailed discussion on the plurality of voids shall be presented in the sections that follow herein below.

The first bonding material 130 has the property that after it has been applied, it can be thermally activated at any later point in time. An example of such a bonding material is shellac glue. In one exemplary embodiment of the invention, the first bonding material 130 is applied to one surface of the layer of spacer material 120, while a second bonding material 140 is applied to another, opposite, surface of the layer of the spacer material 120. The second bonding material 140 is arranged to attach the layer of x-ray absorbing material 110 to the layer of spacer material 120. The second bonding material 140 may not have the property that lets it to be activated at a later point in time. The purpose of the second bonding material 140 is to firmly attach the layers of x-ray absorbing material 110 and the spacer material 120 and to hold the two layers (110, 120) in a specific orientation with respect to each other. An example for the choice of the second bonding material may be epoxy glue. Preferably, the first bonding material 130 and the second bonding material 140 should be capable of absorbing as little x-rays as possible.

It should be noted that, the layers of x-ray absorbing material 110 and spacer material 120 would typically be in the form of foils having respective thicknesses. Therefore, once these aforementioned layers are arranged together, the result is the composite foil 100 having an exposed layer of the first bonding material 130 on one side, the layer of the spacer material 120, the layer of second bonding material 140 and a layer of the x-ray absorbing material 110 having an exposed surface on an other side of the composite foil.

The plurality of voids 150 can be made in a variety of ways and in a variety of shapes and sizes. As will be appreciated by a person skilled in the art, the material of the spacer layer would play a significant role in determining how the plurality of voids are to be formed and by using what means. One desirable property of the spacer layer is that it should provide sufficient mechanical stability to the anti-scatter device and also be capable of holding the layers of x-ray absorbing material in a desired and pre-determined orientation. This further means that the spacer layer should be capable of not degenerating over time causing an alteration in the orientation of the layers of the x-ray absorbing material.

The plurality of unsealed voids 150 may be formed by chemical means, mechanical means or optical means, and in certain instances, a combination of one or more of the aforementioned means. For example, when the spacer layer comprises a fiber material, such as cotton paper, mechanical means provide an easy way of forming the plurality of unsealed voids 150. The mechanical means could include a contraption that performs in a manner such as a paper-punching machine, having the desired depth of punch and the shape of punch. The contraption could, further, be configured to suit different thickness and type of spacer material as desired.

In yet another implementation, the plurality of unsealed voids 150 may be formed by chemical means, such as selective chemical etching to form the desired shape and size of the voids. By suitably controlling the exposure of the spacer material to different kinds of solvents or gases, the shape and size of the voids can be controlled.

In certain other implementation, using optical means such as lasers may form the plurality of unsealed voids 150. Using lasers has a good advantage that the accuracy of the plurality of voids and the exact geometry of the voids can be easily controlled and adjusted. Typically, when lasers are used to form the voids, it is controlled by means of a microprocessor that can be dynamically programmed to form various sizes and shapes of voids or can be pre-programmed for a specific requirement.

While the sections herein above discussed in detail about the formation of the plurality of unsealed voids, it should also be noted that the layer of spacer material could, in certain implementations, comprise multiple slices. These slices, when properly and accurately arranged, may leave voids in between each of the slice thereby forming a plurality of voids in the layer of spacer material.

Figure 2:
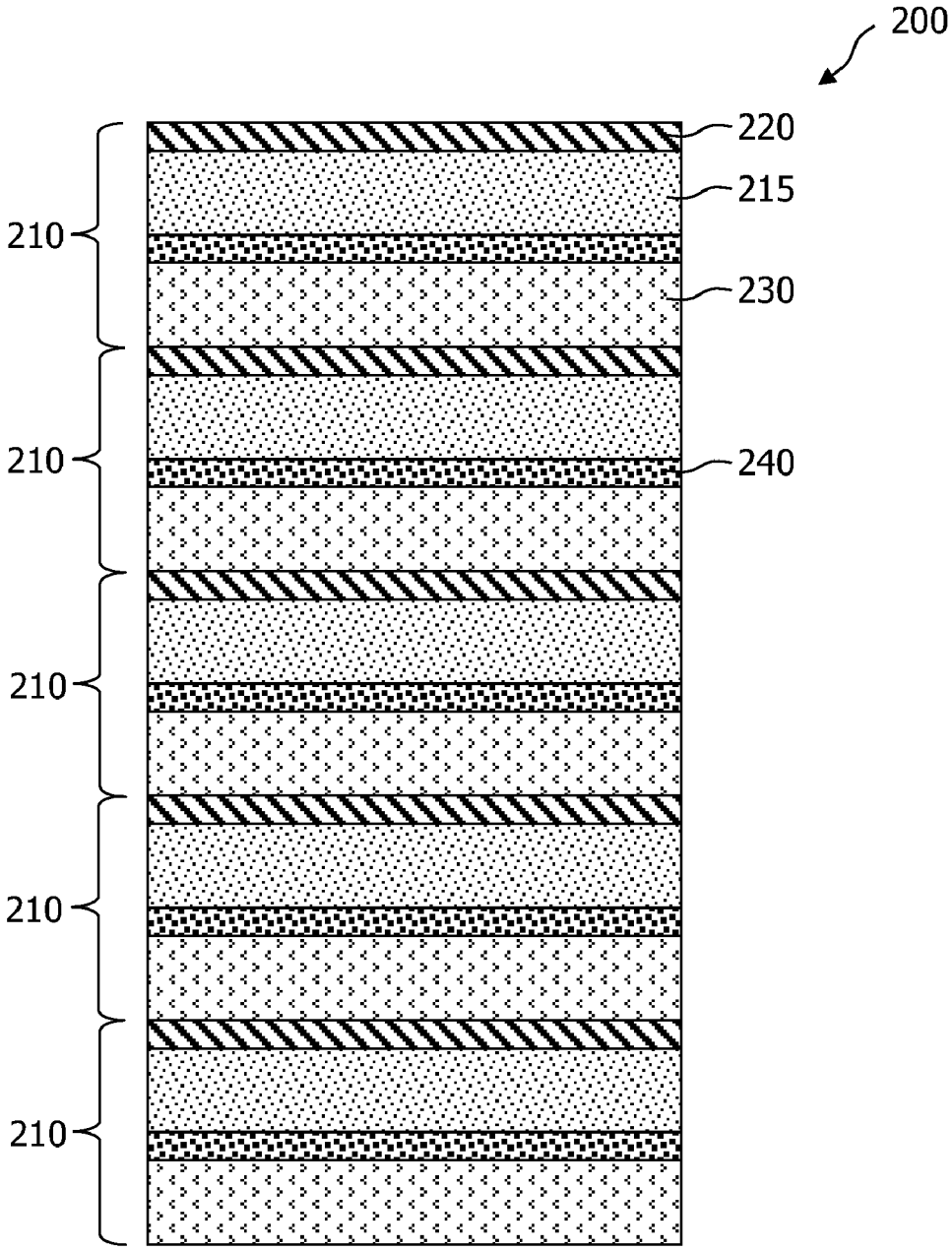
FIG. 2 is a diagrammatical representation of an exemplary stack of composite strips, each strip comprising an x-ray absorbing layer, a spacer layer, a first bonding material and a second bonding material.

Returning back to the discussion of FIG. 1, the composite foil 100, thus formed, is then cut into a plurality of composite strips, such that each composite strip has the same cross sectional layers as that of the composite foil. FIG. 2 illustrates an exemplary stack that forms the anti-scatter device 200. The anti-scatter device 200 comprises a plurality of composite strips 210, each composite strip generally represented by reference numeral 210. As will be known from previous discussion, each composite strip will include a layer of x-ray absorbing material 215, a layer of spacer material 230, a first bonding material 220 and a second bonding material 240. As will be evident from FIG. 2, the layer of the first bonding material 220 in a particular composite strip 210 will be in contact with the layer of x-ray absorbing material 215 on another composite strip 210 above it. In this way, by the addition of composite strips 210 to the stack, a device for selectively passing x-rays and having a particular dimension can be formed, where each composite strip can be oriented at a specific angle of incidence of x-rays. It should be particularly noted that once the composite strips are placed in a specific orientation, the first bonding material 220 in each of the composite strips 210 is activated. Activation of the first bonding material 220 can be done in a variety of ways. For example, in certain implementation, when the first bonding material 220 is shellac glue, the first bonding material 220 may be activated by providing thermal energy to the stack of composite strips. The shellac glue gets activated, and each composite strip 210 gets stuck to the composite strip located above it and forms a rigid structure representing an anti-scatter device that can be used to selectively pass x-rays. It should be particularly noted that once the rigid structure is formed, the orientation of the composite strips may not be preferably changed.

Figure 3:
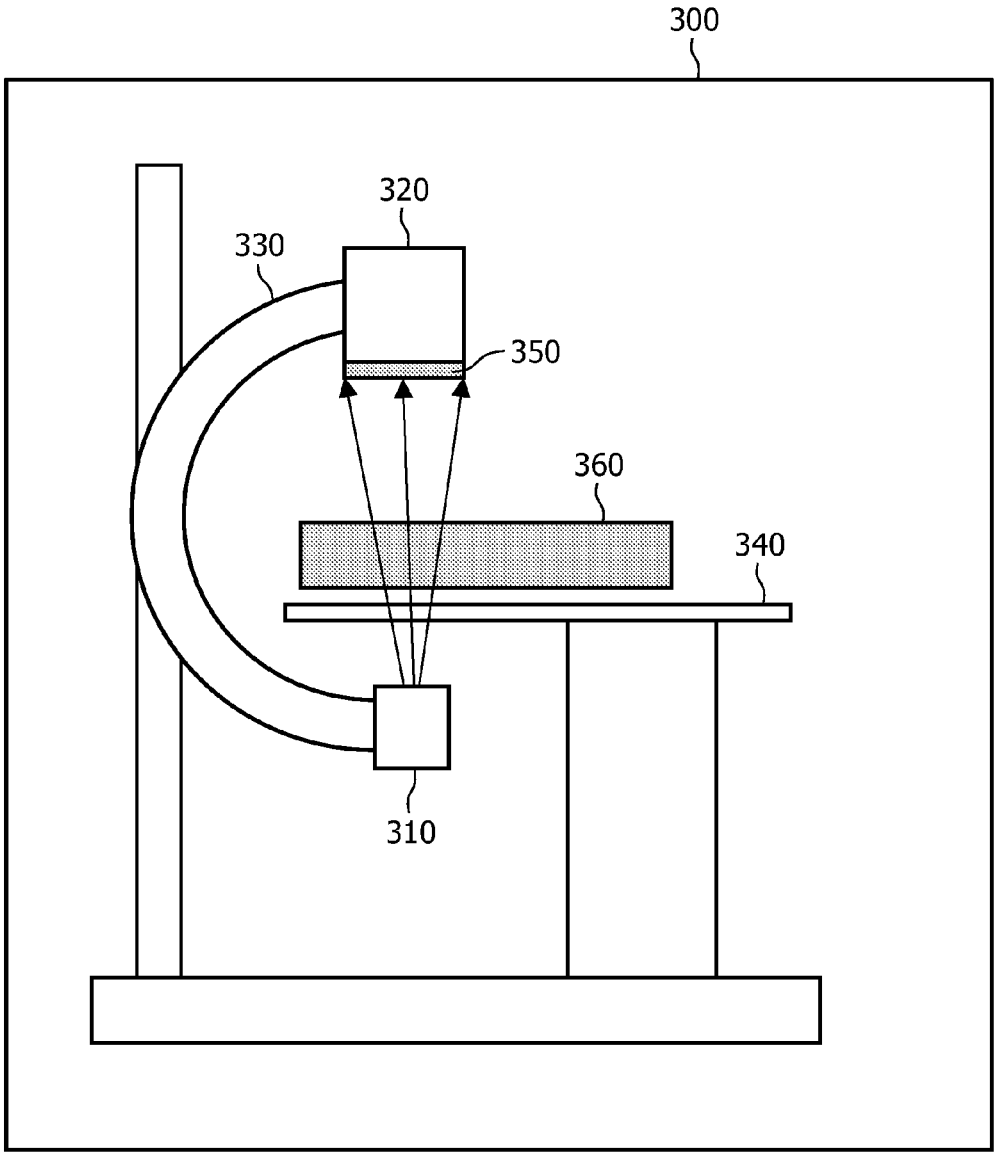
FIG. 3 is a diagrammatical illustration of an exemplary x-ray imaging system comprising an anti-scatter device.

To elucidate the use of this stack, consider an exemplary x-ray imaging system 300 as illustrated in FIG. 3. The x-ray imaging system 300 includes an x-ray source 310, and an x-ray detector 320. These are mounted on a movable arm 330 to provide mobility of the source 310 and the detector 320 over any desired region. The imaging system 300 further includes a patient table 340. The x-ray detector 320 has mounted on it, an anti-scatter device 350. The anti-scatter device 350 is a detachable unit and is used essentially to remove of any background haze or loss of contrast in the generated x-ray image that are caused by scattered radiation. The anti-scatter device 350 is situated always between the x-ray detector 320 and an object 360 undergoing an imaging procedure and placed on the patient table 340.

As mentioned previously, by employing an anti-scatter device in accordance with different aspects of the present technique, the x-ray dosage that a patient would receive during an imaging procedure is significantly reduced and as will be described in the sections herein below, the anti-scatter device embodied herein is also inexpensive. It is also worth noting, that the anti-scatter device is also typically enclosed or encapsulated to provide it with a rigid and strong outer casing. Using carbon fiber or carbon composites for encapsulation has an advantage that the anti-scatter device is transparent to x-rays and does not cause any distortion in the x-rays that pass through it. Furthermore, the distance between the x-ray source and the x-ray detector is typically constant. This is the reason that anti-scatter devices are almost always custom designed in accordance with the design specification for each specific x-ray imaging system. This is also why that the different layers of x-ray absorbing material and spacer material have to be oriented in a specific angle or direction during the formation of the anti-scatter device. This means that, a particular anti-scatter device designed for one particular model of an x-ray imaging system may not be used with similar or equal effect in a different x-ray imaging system.

Figure 4:
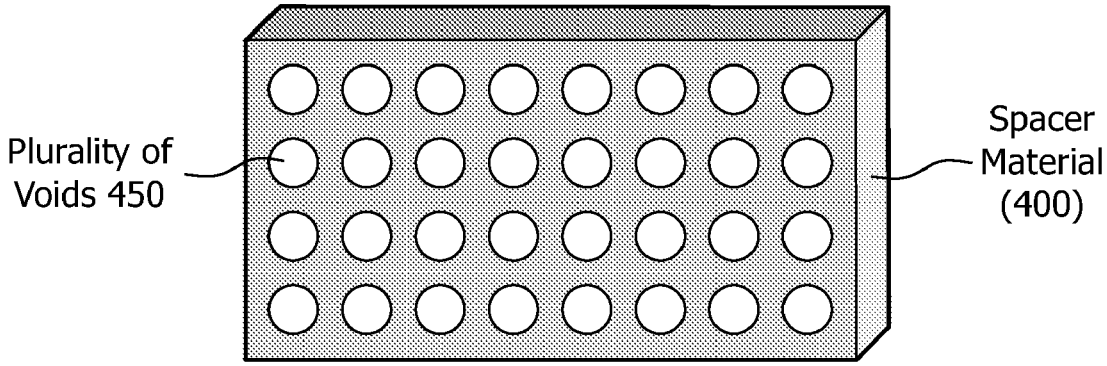
FIG. 4 is a diagrammatical illustration of an exemplary spacer layer having a plurality of voids.
Figure 5:
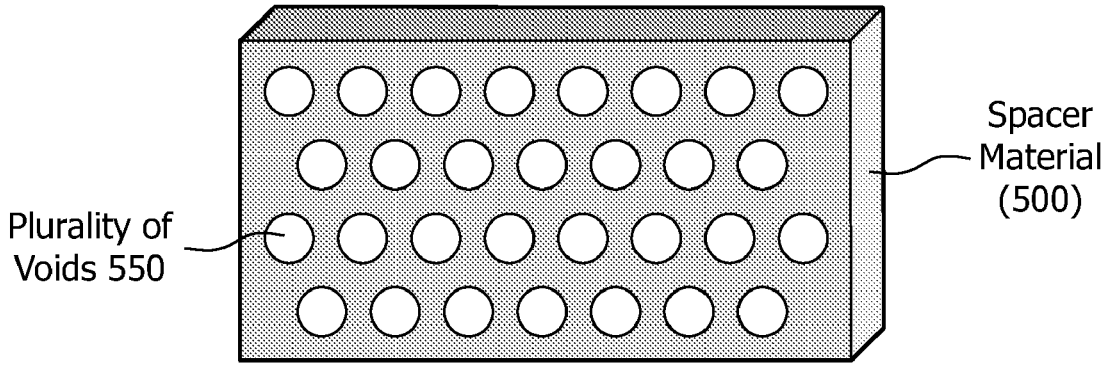
FIG. 5 is a diagrammatical illustration of another exemplary spacer layer having a plurality of voids.
Figure 6:
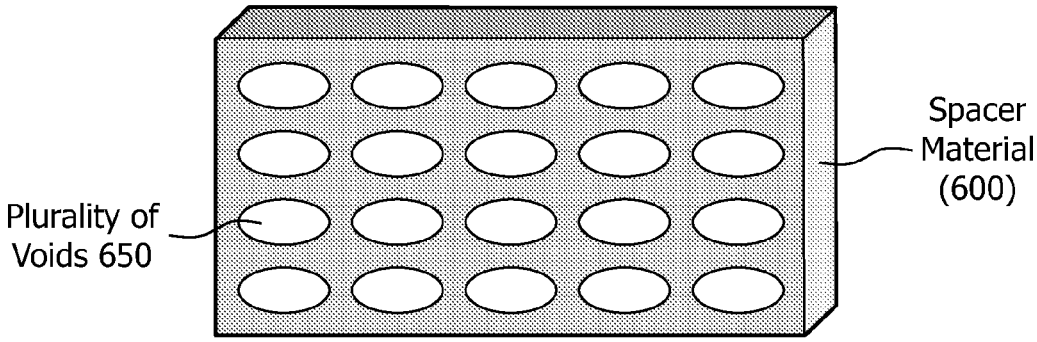
FIG. 6 is a diagrammatical illustration of another exemplary spacer layer having a plurality of voids.
Figure 7:
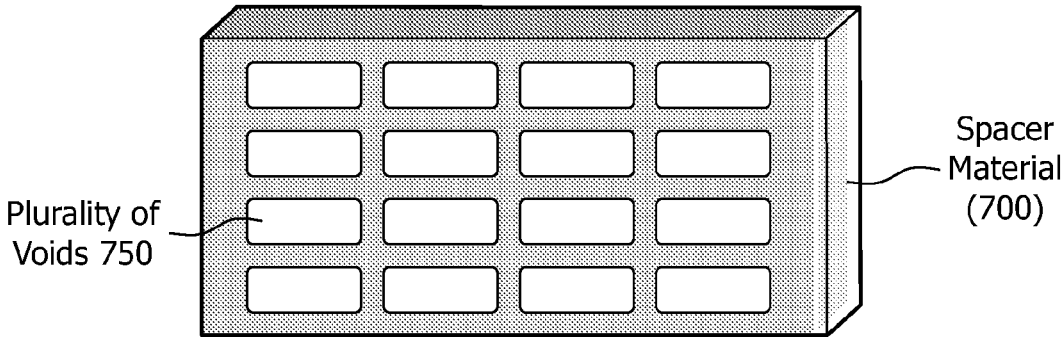
FIG. 7 is a diagrammatical illustration of an exemplary spacer layer having a plurality of voids.

FIG. 4 illustrates one exemplary embodiment of a layer of spacer material 400 comprising a plurality of unsealed voids 450. As illustrated, the plurality of unsealed voids 450, circular in this case, are arranged along defined rows and columns. An advantage of having such an arrangement is the ease of forming the plurality of unsealed voids. FIGS. 5 through 7 illustrate different embodiments of a layer of spacer material 500, 600, 700 respectively, each having a particular pattern of the plurality of unsealed voids 550, 650 and 750 respectively. FIG. 5 illustrates the plurality of unsealed voids 550 that are circular but arranged in a staggered orientation. An advantage of such staggering is that more unsealed voids can be made on a given area of the spacer material 500. However, care should be taken to ensure that mechanical rigidity of the spacer material, and thereby that of the anti-scatter device is not compromised.

FIG. 6 illustrates the embodiment of the spacer material 600 where the unsealed voids are elliptical in shape and arranged along a definite row and column arrangement. While not illustrated, it should be noted that the elliptical shaped unsealed voids could also be arranged in a staggered arrangement as illustrated in FIG. 5 for the case of circular unsealed voids. FIG. 7 illustrates an arrangement of rectangular shaped unsealed voids 750 on an exemplary embodiment of the spacer material 700. The advantage of the embodied arrangement is that there can be maximum utilization of space to provide the unsealed voids 750 on the spacer material 700.

While the preceding FIGS. 4 through 7 illustrated various exemplary embodiments depicting various shapes and arrangements of the plurality of unsealed voids on the spacer material, it should be realized that these representations are not to be considered as limiting. In certain exemplary implementations, the spacer material may have a combination of one or more of the embodied shapes of the unsealed voids or may include certain shapes that are not illustrated herein. Such deviations to achieve similar effects as presented herein should be construed as being within the scope of the present invention.

Figure 8:
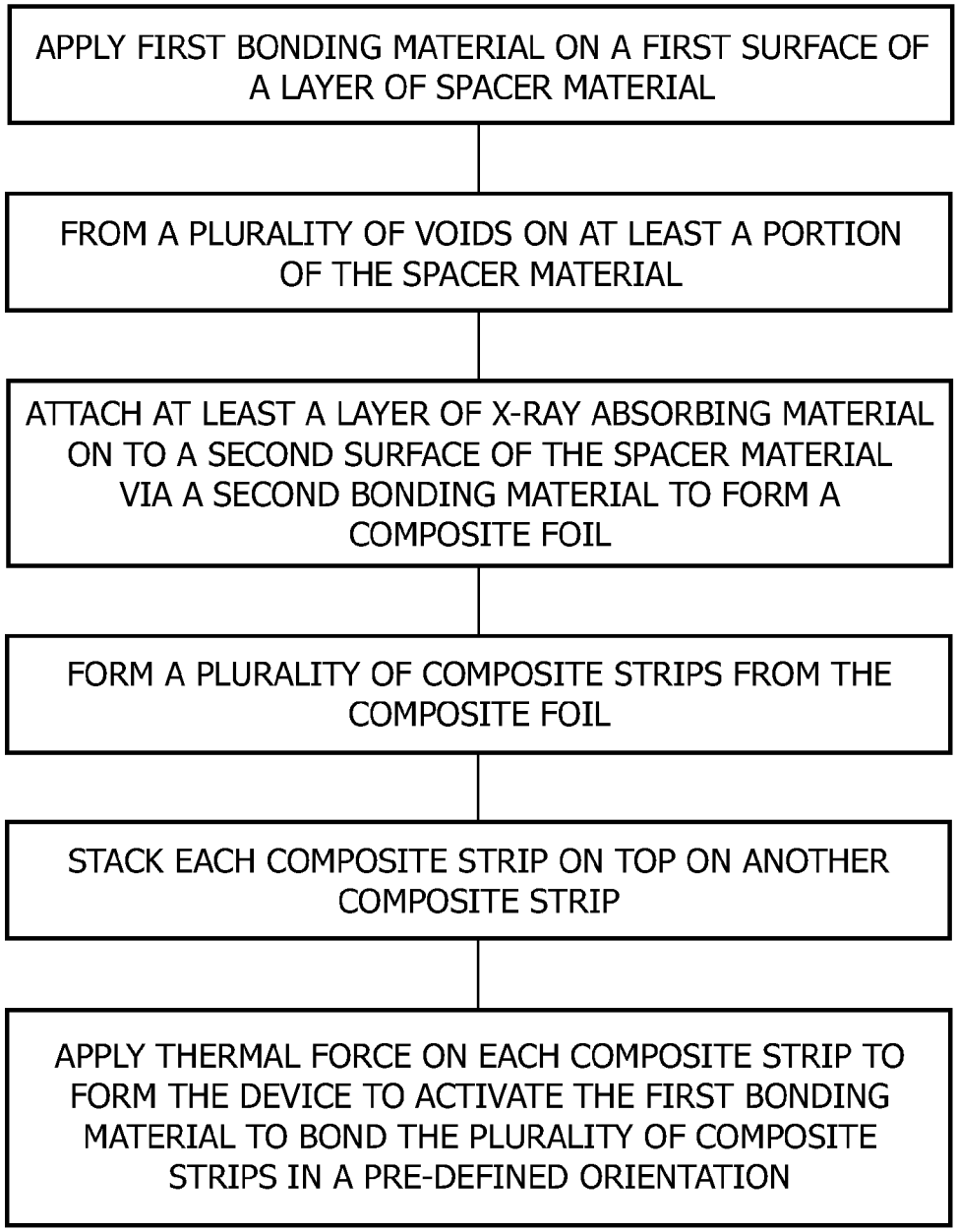
FIG. 8 illustrates an exemplary method of manufacturing an anti-scatter device for selectively passing x-rays.

FIG. 8 illustrates an exemplary method of manufacturing an anti-scatter device. In the illustrated embodiment, the method involves applying the first bonding material on a first surface of a layer of the spacer material. The method also involves forming a plurality of unsealed voids on at least a portion of the spacer material. Further, the method involves attaching at least a layer of x-ray absorbing material onto a second surface of the layer of the spacer material via a second bonding material to form a composite foil. Furthermore, the method involves forming a plurality of composite strips from the composite foil and stacking each composite strip on top of another composite strip. Finally, the method involves applying heat (thermal energy) on each composite strip to activate the first bonding material to bond the plurality of composite strips in a predefined orientation to form the anti-scatter device.

Figure 9:
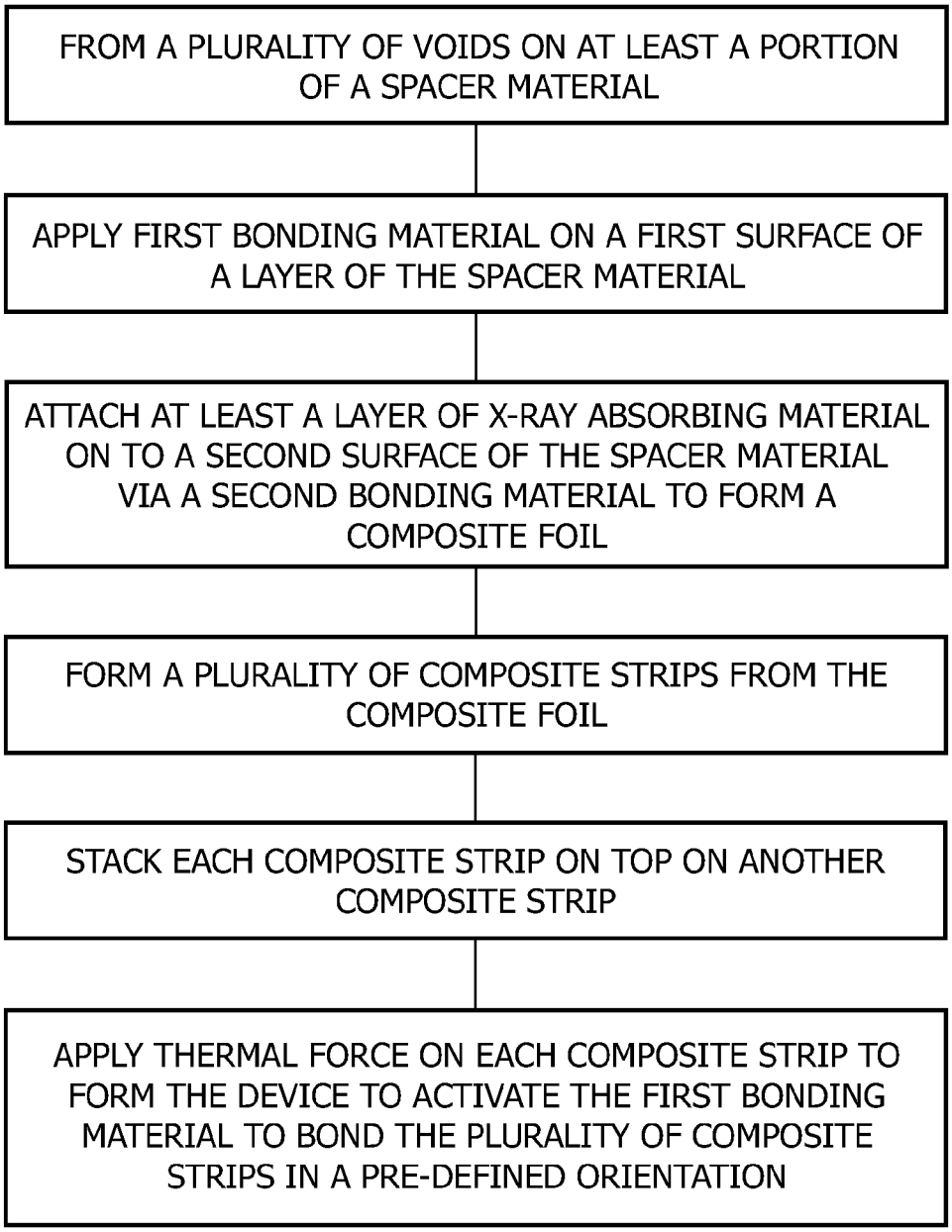
FIG. 9 illustrates another exemplary method of manufacturing an anti-scatter device for selectively passing x-rays.

As discussed previously, in certain other embodiments, another exemplary method of manufacturing the anti-scatter device, as illustrated in FIG. 9, may comprise the step of forming the plurality of unsealed voids on at least a portion of the layer of the spacer material prior to applying the first bonding material on a first surface of the layer of the spacer material.

The order in the described embodiments of the method of the current invention is not mandatory, a person skilled in the art may change the order of steps or perform steps concurrently using threading models, multi-processor systems or multiple processes without departing from the concept as intended by the current invention.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the system claims enumerating several means, several of these means can be embodied by one and the same item of computer readable software or hardware. The mere fact that certain measures are recited in mutually different dependent claims does not indicate that a combination of these measures cannot be used to advantage.

The invention claimed is:

1. An anti-scatter device for suppressing scattered radiation, comprising:

a plurality of x-ray absorbing layers; and a plurality of spacer layers, each spacer layer of the plurality of spacer layers being arranged between any two of the plurality of x-ray absorbing layers to hold the plurality of x-ray absorbing layers in a pre-defined orientation; at least one spacer layer of the plurality of spacer layers further comprising:

a plurality of voids, wherein each void of the plurality of voids has an open end on a surface of the at least one spacer layer to reduce absorption of x-rays incident on at least a portion of the at least one spacer layer, and wherein the at least one spacer layer includes a plurality of slices arranged to leave spaces in between each of the plurality of slices to form the plurality of voids.

2. The anti-scatter device as claimed in claim 1, wherein the plurality of voids is formed via a mechanical means, a chemical means, an optical means or combinations thereof.

3. The anti-scatter device as claimed in claim 1, wherein the at least one spacer layer comprises at least a fiber material.

4. The anti-scatter device as claimed in claim 1, wherein at least one of the plurality of x-ray absorbing layers is joined to at least one of the plurality of spacer layers via a bonding material.

5. The anti-scatter device of claim 1, wherein the surface having the plurality of voids faces one of the plurality of x-ray absorbing layers.

6. The anti-scatter device of claim 1, wherein the surface having the plurality of voids is attached to one of the plurality of x-ray absorbing layers via a bonding material.

7. The anti-scatter device of claim 1, wherein the plurality of voids is along an axis parallel to a longitudinal axis of the anti-scatter device.

8. The anti-scatter device of claim 1, wherein the open end is not covered by material of the at least one spacer layer.

9. The anti-scatter device of claim 1, wherein the plurality of voids includes voids of different shapes and sizes.

10. A method for manufacturing an anti-scatter device for suppressing scattered radiation, the method comprising the acts of:

applying a first bonding material on a first surface of a layer of a spacer material;

attaching at least a layer of x-ray absorbing material onto a second surface of the layer of the spacer material via a second bonding material to form a composite foil, the second surface being different from the first surface;

forming a plurality of voids, wherein each void of the plurality of voids has an open end on a surface of at least a portion of the spacer material;

forming a plurality of composite strips from the composite foil;

stacking each composite strip from the plurality of composite strips over another composite strip from the plurality of composite strips;

applying heat on the stacked composite strips to activate the first bonding material and to bond the plurality of composite strips in a pre-defined orientation, wherein the act of forming the plurality of voids includes forming a plurality of slices of the spacer material, and arranging the plurality of slices to leave spaces in between each of the plurality of slices to form the plurality of voids.

11. The method for manufacturing of the anti-scatter device as claimed in claim 10, wherein the act of forming the plurality of voids is performed prior to the act of applying the first bonding material.

12. The method for manufacturing of the anti-scatter device as claimed in claim 10, wherein the act of forming the plurality of voids is performed prior to the act of attaching to form the composite foil but after the act of applying the first bonding material.

13. The method for manufacturing of the anti-scatter device as claimed in claim 10, wherein the act of forming the plurality of voids is performed via at least one of a mechanical means, a chemical means and an optical means.

14. The method of claim 10, wherein the surface having the plurality of voids is attached to the layer of x-ray absorbing material via the first bonding material.

15. The method of claim 10, wherein the plurality of voids is formed along an axis parallel to a longitudinal axis of the anti-scatter device.

16. The method of claim 10, wherein the act of forming the voids includes at least one of drilling, punching, etching or locally heating the surface to form the plurality of voids.

17. The method of claim 10, wherein the open end is not covered by the spacer material.

18. Use of an anti-scatter device for suppressing scattered radiation in an x-ray imaging apparatus, the use comprising:

providing the anti-scatter device for attachment on a detecting surface of the x-ray imaging apparatus, the detecting surface arranged to receive at least a portion of x-rays emitted by the x-ray imaging apparatus and via the anti-scatter device, the anti-scatter device further comprising:

a plurality of x-ray absorbing layers arranged in a pre-defined orientation;

a plurality of spacer layers, each spacer layer of the plurality of spacer layers being arranged between any two of the plurality of x-ray absorbing layers and arranged to hold the plurality of x-ray absorbing layer in the pre-defined orientation; wherein at least one spacer layer of the plurality of spacer layers comprises:

a plurality of voids, wherein each void of the plurality of voids has an open end on a surface of the at least one spacer layer, the plurality of voids being arranged to reduce absorption of x-rays incident on at least a portion of the at least one spacer layer, and wherein the at least one spacer layer includes a plurality of slices arranged to leave spaces in between each of the plurality of slices to form the plurality of voids.

* * * * *